US005700608A

United States Patent [19]

Eshelman et al.

[11] Patent Number: 5,700,608

[45] Date of Patent: Dec. 23, 1997

[54] PROCESS FOR MAKING PHOTOGRAPHIC EMULSIONS AND PHOTOGRAPHIC ELEMENTS AND EMULSIONS CONTAINING LATENT IMAGE FORMING UNITS INTERNALLY CONTAINING SENSITIZING DYE

[75] Inventors: Lyn Marie Eshelman, Penfield; David Darrell Miller; David Howard Levy, both of Rochester, all of N.Y.

[73] Assignee: Eastman Kodak Company, Rochester, N.Y.

[21] Appl. No.: 618,481

[22] Filed: Mar. 19, 1996

Related U.S. Application Data

[60] Provisional application No. 60/001,699 Jul. 31, 1995.

[51] Int. Cl.[6] ..... G03C 1/035; G03C 1/12

[52] U.S. Cl. ..... 430/20; 430/567; 430/569; 430/570; 430/572; 430/571; 430/576; 430/581; 430/588; 430/592

[58] Field of Search ..... 430/20, 570, 571, 430/572, 567, 569, 576, 581, 588, 592

[56] References Cited

U.S. PATENT DOCUMENTS 2,304,940 1/1942 Mannes et al. ..... 95/2

4,692,401 9/1987 House ..... 430/570

5,322,887 6/1994 Howell et al. ..... 524/781

OTHER PUBLICATIONS

"Incorporation of Spectral Sensitizing Dyes into Large AgBr Crystals", Photographic Science and Engineering, vol. 28, No. 5, 1984, pp. 202–207.

*Primary Examiner*—Richard L. Schilling

*Attorney, Agent, or Firm*—Peter C. Cody; Sarah Meeks Roberts

[57] ABSTRACT

A photographic element is described which comprises a silver halide emulsion having incorporated therein a latent image forming unit, said unit being comprised of an agglomeration of silver halide in conductive contact with a light absorbing center, wherein the center is comprised of:

(i) an amorphous or liquid crystalline spectral sensitizing dye; or (ii) a plurality of spectral sensitizing dye crystals.

Also described is a process for forming a silver halide emulsion and the emulsion prepared by such process.

22 Claims, 2 Drawing Sheets

500nm

PROCESS FOR MAKING PHOTOGRAPHIC EMULSIONS AND PHOTOGRAPHIC ELEMENTS AND EMULSIONS CONTAINING LATENT IMAGE FORMING UNITS INTERNALLY CONTAINING SENSITIZING DYE

CROSS REFERENCE TO RELATED APPLICATION

Reference is made to and priority claimed from U.S. Provisional application Ser. No. U.S. Ser. No. 60/001,699, filed 31 Jul. 1995, entitled PROCESS FOR MAKING PHOTOGRAPHIC EMULSIONS AND PHOTOGRAPHIC ELEMENTS AND EMULSIONS CONTAINING LATENT IMAGE FORMING UNITS INTERNALLY CONTAINING SENSITIZING DYE.

FIELD OF THE INVENTION

This invention relates to photography. In particular, this invention relates to a limited coalescence process for making silver halide emulsions that comprise a spectral sensitizing dye in conductive contact with a silver salt. The invention also relates to silver halide elements, and to emulsions prepared by the inventive process.

BACKGROUND OF THE INVENTION

Photography is the science of capturing an image on a tangible medium by exposing a light sensitive material to actinic radiation and subsequently processing the material to produce a visible image. Typically, silver halide is utilized as the light sensitive component of the light sensitive material. Upon exposure, it forms what is known in the art as a latent image, which is the invisible precursor of the useful visible image that appears during photographic processing. The latent image, and more specifically the metallic silver which comprises the latent image, serves to catalyze the reduction of silver ions to silver metal during processing, thus forming the visible image in black and white photographic materials, and forming dye precursors to the visible image in color negative or color reversal photographic materials.

Because the formation of images in photography is dependent upon the exposure of a light sensitive material to actinic radiation, it follows that the formation of images can be impacted by either the level of actinic radiation or the inherent sensitivity of the light sensitive material. The level of actinic radiation—i.e., the brightness of the scene that is to be recorded—is often outside of the control of the photographer, except perhaps to the extent that it may be partially controlled by the use of flashes and the like. The sensitivity (or "speed") of the light sensitive material, on the other hand, may be selected by the photographer to record an image under a given set of conditions.

Current photographic materials exhibit sensitivities that are much higher than their predecessors. However, the industry remains focused on improving the sensitivities of its products even further.

It has been recognized in the art that photographic sensitivity can be increased by adjusting the pH and/or the pAg of a silver halide emulsion. It has also been known that enhanced photographic sensitivity can be obtained by the addition of certain types of compounds called chemical sensitizers to photographic emulsions. Transition metal complexes such as platinum, iridium, osmium and rhodium complexes, and reduction sensitizers such as stannous chloride and alkynylamines, have also been utilized to improve sensitivity. These compounds and complexes, however, suffer from the disadvantage that when used at excessive levels, they have the potential for causing an increase in the emulsion's fog levels. It therefore becomes incumbent upon the emulsion maker to utilize a level of sensitizing compound that provides an optimum balance between fog and sensitization.

It has also been recognized that the sensitivity of a photographic emulsion can be improved by increasing the average size of the silver halide grains contained within it. However, it has been determined that grain size is directly proportional to the granularity of the emulsion. Thus, above a certain mean grain size, improved sensitivity is impractical as granularity becomes unacceptable.

A further technique for increasing the sensitivity of a photographic emulsion is to adsorb to the surfaces of the emulsion's silver halide grains a spectral sensitizing dye. While this approach is in some instances employed to increase sensitivity in the spectral region of native grain sensitivity, it is more commonly employed to impart sensitivity to a grain outside its region of native sensitivity. In either instance, though, it is believed that during exposure of the emulsion, absorption of a photon by the dye promotes an electron from a ground state to an excited state. In the excited state, the electron (or hole left by the promoted electron) is transferred to the conduction (or valence) band of the silver halide on which the dye is adsorbed. This either reduces silver ion to silver metal thus forming a latent image in negative-working emulsions, or oxidizes silver metal to silver ion thus eliminating pre-existing latent image in positive-working emulsions.

Although sensitivity may be improved in this manner, it has its limitations. In general, increasing the level of spectral sensitizing dye adsorbed to a grain's surface beyond that which provides a monomolecular coverage of dye does not further increase the grain's sensitivity. In fact, beyond the level which provides a monomolecular coverage, sensitivity often decreases. The reasons for this are not entirely understood but it is believed that when used in excess, dye interferes with the ability of processing solutions, namely developer, to reach, and thus develop, the grain. It is also believed that excess levels of dye may bleach (i.e., oxidize) latent image containing grains, thus rendering such grains non-developable.

With such limitations confronting the photographic industry, the present inventors sought to provide a way in which to incorporate spectral sensitizing dyes into silver halide grains at levels unknown in the art and which would impart to the grains a unique spectral sensitivity. Further, the inventors thought to accomplish this without providing grains whose development would be impeded by the presence of high levels of spectral sensitizing dye.

It was known from House, U.S. Pat. No. 4,692,401 that essentially epitaxial deposits of silver halide could be formed in "conductive contact" with a host sensitizing dye crystal, and that such a host crystal could be "effectively shelled" by silver halide; and from Maskasky, "Incorporation of Spectral Sensitizing Dyes into Large AgBr Crystals" Photographic Science and Engineering, Vol. 28, No. 5, 1984, pp. 202–207, that large silver bromide crystals could be grown in the presence of spectral sensitizing dye to form grains having incorporated up to 1 millimole of a spectral sensitizing dye per mole of silver halide. Both of these references, however, fail to provide the means by which to incorporate other than a single discrete dye crystal in a silver salt. Maskasky further is deficient in its failure to describe, or provide a means to construct, silver bromide crystals having incorporated therein large amounts (i.e., greater than 1 millimole) of spectral sensitizing dye at grain sizes of interest to photography.

SUMMARY OF THE INVENTION

This invention provides a photographic element, a process of forming a photographic emulsion, and the photographic emulsion produced by the inventive process. The invention contemplates the use of a variant of a process generally known as "limited coalescence", which has heretofore been utilized to prepare polymeric particles for use in electrostatographic toners, and which will be discussed below in considerable detail.

Specifically, the invention provides a photographic element comprising a silver halide emulsion having incorporated therein a latent image forming unit, said unit being comprised of an agglomeration of silver halide in conductive contact with a light absorbing center, wherein the center is comprised of:

(i) an amorphous or liquid crystalline spectral sensitizing dye; or (ii) a plurality of spectral sensitizing dye crystals.

Also provided is a process of preparing a photographic emulsion having incorporated therein a plurality of latent image forming units, each of said units being comprised of an agglomeration of silver halide in conductive contact with a spectral sensitizing dye, the process comprising:

dispersing a spectral sensitizing dye in an organic medium to form an organic dispersion;

contacting the organic dispersion with an aqueous colloidal dispersion of silver halide grains and providing sufficient agitation to the dispersions to form a series of interfaces between the organic and aqueous phases; and providing to the dispersions a promoter which facilitates the adsorption of the silver halide grains to the interfaces between the organic and aqueous phases to form the latent image forming units.

The photographic emulsion prepared by this process is also contemplated.

The invention provides myriad opportunities for the photographic scientist involved in preparing silver halide emulsions with an eye towards optimizing spectral sensitivity characteristics and grain sensitivity. The invention allows for the construction of latent image forming units which, if thought of as analogous to conventional silver halide grains, contain a previously unattainable level of sensitizing dye. It further allows for the incorporation of multiple dye crystals, each having its own spectral sensitivity, into the latent image forming units. In this manner, the latent image forming units of a photographic emulsion can be tailored to be responsive to virtually any spectral sensitivity.

Additional advantages that can be realized by practice of the invention include the attainment of improved photographic sensitivity ("speed"), which can be directly related to the increased level of sensitizing dye associated with each latent image forming unit, or the fact that additional addenda such as chemical sensitizers can be incorporated into the unit along with the sensitizing dye. Further, by virtue of the latent image forming unit being composed of multiple silver halide grains, unique combinations of halide types, and hence grain/dye associations, can be formed in each latent image forming unit.

DETAILED DESCRIPTION OF THE INVENTION

Figure 1:
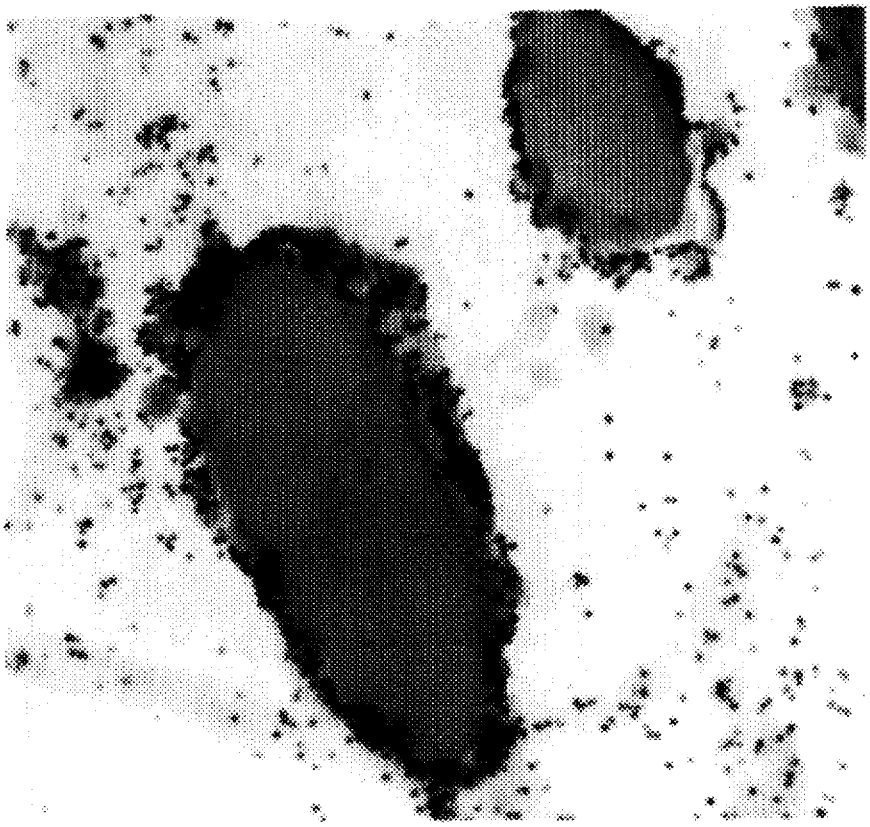
FIG. 1 represents a transmission electron micrograph of a cross-section of the gelatin dispersed latent image forming units formed in Example 1.

The inventors have discovered that composite dispersions of silver halide and spectral sensitizing dye, in which small grains of silver halide form a layer on the surface of a core comprising an amorphous or liquid crystalline spectral sensitizing dye, or a plurality of spectral sensitizing dye crystals, and, optionally, a water-insoluble binder material, can be made by a variant of the "limited coalescence" technique described in U.S. Pat. Nos. 2,932,629 and 5,322,887, both of which are incorporated herein by reference. In the instant invention, a dispersion of a spectral sensitizing dye in an organic medium is dispersed in an aqueous colloidal medium comprising small silver halide grains and a compound that helps promote adsorption of the silver halide grains to the water-organic medium interface (hereinafter this compound is referred to as a promoter). In a preferred embodiment of this invention, the organic medium is subsequently removed from the composite dispersion by evaporation, dialysis, or washing. The resulting dispersion can be further stabilized by mixing it with an aqueous phase containing gelatin or other water-soluble polymers and, optionally, one or more water-soluble surfactants.

The composite dispersions formed by practice of the invention will contain as latent image forming units an agglomeration of silver halide grains in conductive contact with a spectral sensitizing dye. "Conductive contact" is taken to mean that the dye is the primary receptor of exposing radiation, and is conductively associated with at least one of the silver halide grains so as to be able to transfer the energy it receives to the grain, thus facilitating formation of a latent image. For a more comprehensive description of silver halide grains being in conductive contact with spectral sensitizing dyes, see U.S. Pat. No. 4,692,401 (particularly columns 3 and 5–9), which is incorporated herein by reference.

The spectral sensitizing dye which forms the light absorbing center conductively associated with the silver halide can be in the form of a plurality (i.e., ≧2) of discrete spectral sensitizing dye crystals. It may also take the form of an amorphous dye, which can be solid or liquid, or a liquid crystalline dye.

Typically, the spectral sensitizing dye of interest is dispersed in an organic medium that contains one or more stabilizers or grinding aids and, optionally, an organic medium-soluble, but water-insoluble, binder material.

The organic medium in which the spectral sensitizing dye is dispersed is chosen from a wide range of organic solvents, and is acceptable for the purposes of the present invention if it is partially water immiscible or water insoluble. Preferably, the partially water immiscible or water insoluble organic medium has a solubility in water of less than 10%.

An illustrative list of suitable organic solvents is set forth below.

A-1 methyl isobutyl ketone
A-2 methyl acetate
A-3 2-methyl tetrahydrofuran
A-4 isobutyl acetate A-5 2-ethoxyethyl acetate
A-6 2-(2-butoxyethoxy)ethyl acetate
A-7 4-methyl-2-pentanol
A-8 ethyl acetate
A-9 diethyl carbitol
A-10 triethyl phosphate
A-11 cyclohexanone
A-12 2-benzyloxyethanol
A-13 2(2-ethoxyethoxy)ethyl acetate
A-14 methylene chloride
A-15 1,1,2-trichlorethane
A-16 1,2-dichloropropane
A-17 toluene
A-18 xylene
A-19 hexane
A-20 cyclohexane
A-21 heptane The spectral sensitizing dye utilized in the invention can be any spectral sensitizing dye, but is preferably selected from the poly-methine dye class, which includes the cyanines, merocyanines, complex cyanines and merocyanines (i.e., tri-,tetra-, and poly-nuclear cyanines and merocyanines), oxonols, hemioxonols, styryls, merostyryls, and streptocyanines. Other acceptable dyes include phthalocyanine dyes, including copper phthalocyanine.

Where the spectral sensitizing dye is in the form of a plurality of crystals, it is preferred that each crystal has a mean diameter of from about 0.05 to about 5 μm, although it is contemplated that such diameter may range from as little as the grain sizes found in Lippmann emulsions to over 20 μm. Optimally, each crystal will have a mean diameter of about 0.05 to about 2 μm.

The dye crystals utilized in the invention can be prepared by conventional means, such as by employing known crystallization techniques with subsequent washing and purification steps. Dispersal and particle size reduction can be accomplished by subjecting the solid dye crystals in an organic medium to repeated collisions with beads, typically of hard, inorganic milling media, such as sand, spheres of silica, stainless steel, silicon carbide, glass, zirconium, zirconium oxide, alumina, titanium, etc. which fracture the crystals. The bead sizes typically range from 0.25 to 3.0 mm in diameter.

Ball mills, media mills, attritor mills, jet mills, vibratory mills, etc., can be used to accomplish dispersal and particle size reduction. Milling times vary widely, and depend on the type of mill used, but will generally vary from 30 minutes to two weeks. Milling technology is discussed in UK Patent 1,570,362, U.S. Pat. Nos. 4,006,025, 5,294,916, 4,294,917, 4,940,654, and Colloidal Systems and Interfaces by Sydney Ross and Ian Morrison, Wiley Interscience, 1988, all of which are incorporated herein by reference.

After milling, the dye is optionally mixed with additional organic medium. The organic dispersion is subsequently contacted with an aqueous colloidal dispersion of silver halide grains. The composite dispersion thus formed is then agitated and a promoter, which can be added at any time and to either or both of the dispersions, facilitates formation of the latent image forming units of the invention.

In the invention, the milling step is obviated if the dye is completely soluble in the organic solvent, or if the dye is in the form of an amorphous liquid or liquid crystal. Furthermore, the dye need not be milled if it is an amorphous solid, although it is preferable to do so. Size distributions for particulate solid amorphous dyes are as described above with respect to dye crystals.

Amorphous dyes, whether solid or liquid, are known and may be prepared by methods known in the art. By amorphous liquid dyes, it is meant dyes that are either liquids in pure form, or are dissolved in a water immiscible organic liquid. By amorphous solid dyes, it is meant non-crystalline solids (e.g. glasses) that can be prepared, for example, by rapidly cooling a dye from its molten state, or by removing the solvent from a solution of dye in organic solvent in such a way as to prevent crystallization of the dye. This is typically accomplished by rapid removal of the solvent by evaporation, or by incorporation of other materials in the solution that are not removable by evaporation, such as other dyes or polymers, followed by evaporation.

Liquid crystalline spectral sensitizing dyes are known in the art and are described in Tiddy et al., "Highly Ordered Aggregates in Dilute Dye-Water Systems" Langmuir, Vol. 11(2), 1995, pp. 390–393, incorporated herein by reference. These dyes are liquid crystalline in an aqueous environment. It is contemplated that the liquid crystalline dyes suitable for use in the invention would be soluble in organic media and would be readily identifiable by one of ordinary skill in the art. Neubert et al., "Synthesis and Characterization of Some Azo-Anil Dyes" Molecular Crystals and Liquid Crystals, Vol. 260 1995, pp. 287–300, incorporated herein by reference, is representative for describing such dyes.

The level of dye dispersed in the organic solvent can vary over a wide range, but is typically in the order of about 0.01 to about 50%, by weight, of the total dispersion weight. Preferred levels of dye range from about 0.1 to about 40%, and most preferred levels of dye range from about 1 to about 30%.

It is contemplated that upon formation of the latent image forming units incorporated into the elements of the invention, the units will individually contain an amount of spectral sensitizing dye from about 0.5 to about 5000 millimoles per mole of silver. Preferably, each unit will contain an amount of spectral sensitizing dye from greater than 1 to about 1000 millimoles per mole of silver. Optimally, each will contain an amount of spectral sensitizing dye from about 2 to about 500 millimoles per mole of silver. At such levels, the advantages inherent with practice of the invention are most pronounced.

It is also contemplated that dye crystals and/or solid amorphous particles of different spectral sensitivities can be utilized together in each light absorbing center. An exemplary latent image forming unit could thus comprise dye crystals having absorption characteristics across a broad spectrum of spectral sensitivities, and could result in, for example, panchromatic emulsions and/or emulsions exhibiting improved sensitivity.

Stabilizers or grinding aids that can be incorporated along with the spectral sensitizing dye in the organic medium can be chosen from a wide range of surfactant or polymeric materials, but should be soluble or dispersible in the organic solvent of interest. Suitable surfactant or polymeric stabilizers and grinding aids include: various dialkyl sodium sulfosuccinates (sold under Aerosol OT™, Aerosol TR-70™, etc. (American Cyanamid)), various copolymers of poly(ethylene oxide) and poly (propylene oxide) (sold under Pluronic™ and Tetronic™, and including Pluronic L44™, Pluronic F68™, Pluronic L121™, Pluronic F127™, Pluronic P84™, Tetronic 908™, Tetronic 901™, Tetronic 25R8™, Tetronic 50R4™, etc. (BASF)), various polyethoxylated alcohols (for example: Brij 30™ (polyoxyethylene (4) lauryl ether) and Brij 35™ (polyoxyethylene (23) lauryl ether) (ICI Americas), Renex 30™ (polyoxyethylene (12) tridecyl ether (ICI Americas)), various polyethoxylated alkylphenols (for example, Triton X-100™ (octylphenoxy polyethoxy ethanol) (Rohm and Haas), Igepal CO-210™ (ethoxylated nonylphenol) (Rhone-Poulenc/GAF)), copolymers of esters and amines (for example, Solsperse 24000™ (ICI Americas)), poly(vinyl acetate), poly(vinyl methyl ether), etc. Other acceptable surfactants can be found in standard reference works on dispersion making, such as *Dispersing Powders in Liquids*, by R. D. Nelson, Elsevier (1988), which is incorporated herein by reference.

The level of stabilizer or grinding aid can vary over a wide range, but will generally be between about 0.1 and about 100% of the total dye level, by weight. Preferred levels vary from about 1 to about 50% of the total dye level; and most preferred levels vary from about 2 to about 25% of the total dye level.

Prior to the mixing of the organic dispersion in an aqueous colloidal medium containing silver halide, additional materials can be added to the organic dispersion. These include polymeric binders such as poly(styrene), copolymers of butyl acrylate and styrene (for example: Picotoner 1221™ and Picotoner 1278™ (Hercules)), and the like. Other binder materials are discussed in U.S. Pat. No. 5,322,887, which, as indicated, is incorporated by reference. These polymeric binders are conveniently dissolved in organic solvents, such as those listed above, prior to mixing with the organic dispersion.

Charge transfer agents, which are exemplified in Borsenberger & Weiss, Organic Photoreceptors for Imaging Systems, Marcel Dekker, 1993, incorporated herein by reference, may also be added to the organic dispersion prior to it being contacted with the aqueous colloidal dispersion. Other compounds that may be added to the organic dispersion include photographically active moieties as described in *Research Disclosure*, December 1989, Item No. 308119, Sections VII-LJ; VIII; X; XX; and XXI, which is incorporated herein by reference. Suitable photographically active moieties include development accelerators, development inhibitors, bleach accelerators, bleach inhibitors, developing agents (e.g. competing developing agents or auxiliary developing agents), dyes, silver complexing agents, fixing agents, toners, hardeners, fluorescing compounds, tanning agents, fogging agents, antifoggants, and antistain agents.

The aqueous colloidal silver halide dispersion which is combined with the organic dispersion of dye can be of any type, and can be made by conventional techniques, such as described in James, *The Theory of the Photographic Process*, 4th Edition, 1977, chapter 3, which is incorporated herein by reference. Typically, it will contain a low level of gelatin as a stabilizer, the level ranging from 0 to 1% by weight of the total dispersion. Alternatively, the dispersion can contain other stabilizers such as polyvinyl acetate and other surfactants.

When gelatin is utilized as a stabilizer, a variety of gelatin types is contemplated. Such types include acid-processed gelatin, lime-processed gelatin, oxidized gelatin, hydrophobically modified gelatin, partially hydrolyzed gelatin, pthalated gelatin, and acid processed ossein gelatin.

The silver halide grains contained within the aqueous dispersion can have various morphologies but typically are expected to exhibit face centered cubic lattice structures. Known morphologies for silver halide grains exhibiting face centered cubic lattice structures are described in Maskasky, "The Seven Different Kinds of Crystal Forms of Photographic Silver Halide" Journal of Imaging Science, Vol. 30, 1986, pp. 247–255. They include the cube, octahedron, rhombic dodecahedron, trisoctahedron, icositetrahedron, tetrahexahedron, and hexoctahedron. Irregular shaped grains such as tabular, spherical, ruffled and hollow grains, as well as any of the preceding grains having epitaxial deposits situated thereon, are also contemplated for the invention. It is preferred, though, that the grains be cubic or octahedral.

The grains may also be comprised of any single halide or combination of halides. For example, the grains may be silver bromide, silver chloride, silver iodobromide, silver iodochlorobromide, silver chloroiodobromide, silver chlorobromide, silver iodobromochloride, and/or silver bromiodochloride. Other combinations are possible.

In the practice of the invention, the total silver level is preferably about 0.01 to about 10% by weight, and preferably about 0.1 to about 5% by weight, of the total composite dispersion. The silver halide grains preferably have a mean diameter in the range of from about 0.001 to about 5 μm, preferably from about 0.01 to about 2 μm, and most preferably from about 0.02 to about 1 μm.

To control the ionic strength and the DH of the aqueous colloidal silver halide dispersion so as to optimize conditions for the formation of the latent image forming units, the dispersion can also contain various types of electrolytes, and acids, bases or buffers. Exemplary electrolytes include sodium nitrate, calcium acetate, calcium sulfate, and potassium sulfate. Exemplary acids, bases and buffers include hydrochloric acid, sodium hydroxide, tris, sodium bicarbonate, and acetic acid.

Upon practice of the process of the invention, the grains form what is, in essence, an agglomeration on the organic-aqueous interface surrounding the spectral sensitizing dye. The agglomeration of grains serves as a barrier against the complete coalescing of the organic phase. It therefore needs to be of a sufficient size, and contain a sufficient number of discrete grains, so as to substantially encapsulate the light absorbing center. By substantially encapsulate, it is meant a level of silver halide, and a number of silver halide grains, on the surface of the light absorbing center which is sufficient to preclude coalescence of the organic phase and to result in latent image forming units of the desired size. Typically, this amount is that which will result in about 50% or greater (preferably about 70% or greater) of the surface area of the light absorbing center being in direct contact with adsorbed silver halide. It is contemplated, however, that levels below 50% would be attainable where additional particulate stabilizers such as silica or metal oxide dispersions are added to the aqueous phase. These additional particulate stabilizers are thought to behave in a similar manner as the silver halide grains—that is, they adsorb to the organic-aqueous interface and, together with the silver halide grains, prevent complete coalescence of the organic phase. Where the additional compounds are utilized, they, in combination with the silver halide grains, can be expected to be in direct contact with greater than about 50% of the light absorbing center's surface area.

After the silver halide has adsorbed to the organic-aqueous interface and has prevented complete coalescence, the latent image forming units are formed. Typically, though, the organic medium containing the spectral sensitizing dye is allowed to evaporate, or is removed by dialysis or washing. This results in a single aqueous dispersion of latent image forming units wherein the units are relatively spherical in shape, and have a mean circular diameter in the order of about 0.1 to about 10 μm, preferably in the order of about 0.5 to about 10 μm, and optimally in the order of about 0.5 to about 5 μm. Most preferably, at least 50% of the latent image forming units in any given photographic emulsion have an equivalent circular diameter in the ranges specified.

The units have a solid shell or partial shell of silver halide (assuming no other particulate stabilizers are used) which substantially encapsulates an inner core of dye. The units can be combined with additional hydrophilic colloid, such as gelatin, either by adding the hydrophilic colloid to the aqueous-organic composite dispersion before or after removal of the organic phase. Further, they may be subjected to a ripening process whereby additional silver halide is precipitated onto their surfaces. Also, the units may be chemically or spectrally sensitized by methods known in the art, or combined with silver halide grains of any morphology and halide composition.

The promoter utilized in the invention to facilitate adsorption of the silver halide to the organic-aqueous interfaces is preferably added to the aqueous colloidal dispersion of silver halide grains prior to the formation of the composite dispersion, although it may be added to either or both of the dispersions at any time. It is contemplated that the promoter functions by increasing the hydrophobicity of the silver halide, thus driving the silver halide onto the organic-aqueous interface. If the promoter is too effective at increasing the hydrophobicity of the silver halide, the silver halide will tend to partition into the organic medium. If it is not effective enough, sufficient silver halide to preclude complete coalescence will not be present on the organic-aqueous interface. Thus, the selection of suitable promoters should be guided accordingly.

Suitable promoters for the invention include those set forth in U.S. Pat. No. 2,932,629, which, as indicated, is incorporated by reference. Preferred promoters are anionic or cationic salts containing from 1–20 carbon atoms, and will vary depending on the nature of the aqueous and organic dispersions. More preferred are cationic salts containing from 4–20 carbon atoms.

Typical promoters include: sodium butane sulfonate, nonyl trimethyl ammonium bromide, decyl ammonium chloride, decyltrimethylammonium bromide, tetrabutyl ammonium nitrate, sodium octyl sulfate, sodium butyl sulfonate, cysteine, cystine, dithioerythritol, dithiothreitol, butane thiol, and other water soluble compounds having a thiol, sulfide or disulfide functionality.

Levels of promoter will vary with the nature and level of silver halide, organic solvent and dye, and will be readily determinable to one of ordinary skill in the art. Typically, the level of promoter should be from about 0.1 millimoler to about 100 millimoler.

In the preferred embodiment where the aqueous colloidal dispersion contains both silver halide and promoter, the aqueous dispersion is mixed with the organic dispersion containing the organic solvent, dye, stabilizer or grinding aid (optional), and binder (optional) to form a composite dispersion wherein the weight ratio of silver halide to organic solvent is preferably from about 0.0001 to about 1. This mixture is agitated under shearing forces so as to reduce the size of the droplets containing organic solvent and to form a series of interfaces between the organic and aqueous phases. After agitation, an equilibrium is typically reached and the size of the droplets is stabilized by the adsorption of the silver halide grains on the surface of the droplets containing organic solvent, dye, etc. Typical shearing devices include rotor-stator devices, microfluidizers, homogenizers, ultrasonicator, and the like, as described in *Encyclopedia of Emulsion Technology*, Vol I, edited by Paul Becher, Marcel Dekker, 1983, which is incorporated herein by reference.

After agitation, the organic solvent can be removed by evaporation, dialysis (e.g. membrane dialysis) or washing (e.g. noodle washing). Such procedures are described in, for example, U.S. Pat. Nos. 2,322,027; 2,787,544; 2,801,180; 2,801,171; 2,949,360; and 3,396,027, all of which are incorporated herein by reference. The latent image forming units can then be mixed with gelatin and other photographically useful materials prior to coating in a photographic element.

The photographic elements of the invention can be non-chromogenic silver image forming elements. They can be single color elements or multicolor elements. Multicolor elements typically contain dye image-forming units sensitive to each of the three primary regions of the visible spectrum. Each unit can be comprised of a single emulsion layer or of multiple emulsion layers sensitive to a given region of the spectrum. The layers of the element, including the layers of the image-forming units, can be arranged in various orders as known in the art. The element can contain additional layers such as filter layers, interlayers, overcoat layers, subbing layers and the like.

The photographic element may also contain a transparent magnetic recording layer such as a layer containing magnetic particles on the underside of a transparent support, as in U.S. Pat. Nos. 4,279,945 and 4,302,523 and *Research Disclosure, November* 1993, Item 3490, which are incorporated herein by reference. Typically, the element will have a total thickness (excluding the support) of from about 5 to about 30 microns.

In the following Table, reference will be made to (1) *Research Disclosure*, December 1978, Item 17643, (2) *Research Disclosure*, December 1989, Item 308119, (3) *Research Disclosure*, September 1994, Item 36544, all published by Kenneth Mason Publications, Ltd., Dudley Annex, 12a North Street, Emsworth, Hampshire PO10 7DQ, ENGLAND, the disclosures of which are incorporated herein by reference. The Table and the references cited in the Table are to be read as describing particular components suitable for use in the photographic process, emulsion and element according to the invention. The Table and its cited references also describe suitable ways of exposing, processing and manipulating the elements, and the images contained therein.

| Reference | Section | Subject Matter |
|---|---|---|
| 1 | I, II | Grain composition, morphology |
| 2 | I, II, IX, X, XI, XII, XIV, XV | and preparation. Emulsion preparation including hardeners, coating aids, addenda, etc. |
| 3 | I, II, III, IX A & B | |
| 1 | III, IV | Chemical sensitization and |
| 2 | III, IV | spectral sensitization/ |
| 3 | IV, V | desensitization |
| 1 | V | UV dyes, optical brighteners, |
| 2 | V | luminescent dyes |
| 3 | VI | |
| 1 | VI | Antifoggants and stabilizers |
| 2 | VI | |
| 3 | VII | |
| 1 | VIII | Absorbing and scattering |
| 2 | VIII, XIII, XVI | materials; Antistatic layers; matting agents |
| 3 | VIII, IX C & D | |
| 1 | VII | Image-couplers and image- |
| 2 | VII | modifying couplers; Dye |
| 3 | X | stabilizers and hue modifiers |
| 1 | XVII | Supports |
| 2 | XVII | |
| 3 | XV | |
| 3 | XI | Specific layer arrangements |
| 3 | XII, XIII | Negative working emulsions; |

-continued

| Reference | Section | Subject Matter |
|---|---|---|
| | | Direct positive emulsions |
| 2 | XVIII | Exposure |
| 3 | XVI | |
| 1 | XIX, XX | Chemical processing; |
| 2 | XIX, XX, XXII | Developing agents |
| 3 | XVIII, XIX, XX | |
| 3 | XIV | Scanning and digital processing procedures |

Dopants, such as compounds of copper, thallium, lead, bismuth, cadmium and Group VIII noble metals, can be present during process of the present invention or during preparation of silver halide grains employed in the emulsion layers of the photographic element. Other dopants include transition metal complexes as described in U.S. Pat. Nos. 4,981,781, 4,937,180, and 4,933,272.

The silver halide grains of the photographic element can further be surface-sensitized, and noble metal (e.g., gold), middle chalcogen (e.g., sulfur, selenium, or tellurium) and reduction sensitizers, employed individually or in combination, are specifically contemplated.

The silver halide grains and latent image forming units can be spectrally sensitized with dyes from a variety of classes, including the polymethine dye class, which includes the cyanines, merocyanines, complex cyanines and merocyanines (i.e., tri-tetra-, and polynuclear cyanines and merocyanines), oxonols, hemioxonols, styryls, merostyryls, and streptocyanines.

The photographic elements can contain image and image-modifying couplers, brighteners, antifoggants and stabilizers such as mercaptoazoles (for example, 1-(3-ureidophenyl)-5-mercaptotetrazole), azolium salts (for example, 3-methylbenzothiazolium tetrafluoroborate), thiosulfonate salts (for example, p-toluene thiosulfonate potassium salt), tetraazaindenes (for example, 4-hydroxy-6-methyl-1,3,3a,7-tetraazaindene), anti-stain agents and image dye stabilizers, light absorbing and scattering materials, hardeners, polyalkyleneoxide and other surfactants as described in U.S. Pat. No. 5,236,817, coating aids, plasticizers and lubricants, anti-static agents, matting agents, development modifiers.

The photographic elements can be incorporated into exposure structures intended for repeated use or exposure structures intended for limited use, variously referred to as single use cameras, lens with film, or photosensitive material package units.

The photographic elements can be exposed with various forms of energy which encompass the ultraviolet, visible, and infrared regions of the electromagnetic spectrum as well as with electron beam, beta radiation, gamma radiation, x-ray, alpha particle, neutron radiation, and other forms of corpuscular and wave-like radiant energy in either noncoherent (random phase) forms or coherent (in phase) forms, as produced by lasers. When the photographic elements are intended to be exposed by x-rays, they can include features found in conventional radiographic elements.

The photographic elements are preferably exposed to actinic radiation, typically in the visible region of the spectrum, to form a latent image, and then processed to form a visible dye image as described above. Development is typically followed by the conventional steps of bleaching, fixing, or bleach-fixing, to remove silver or silver halide, washing, and drying.

The following examples illustrate the practice of this invention. They are intended to be illustrative, and therefore should not be taken as exhaustive of all possible variations of the invention.

Example 1

An aqueous colloidal dispersion of silver halide grains (Dispersion A), was prepared as follows: 2.3 liters of 0.4% aqueous oxidized gelatin solution containing 0.014 moles of sodium bromide was placed in a stirred reaction vessel at 40° C. A mixed halide salt solution containing 2.415 moles of NaBr per liter and 0.085 moles of KI per liter was used to control the pAg during conventional double jet precipitation at the indicated levels. At pAg of 9.1, a 2.5M silver nitrate solution was added to the reaction vessel at 25 ml/minute for 30 seconds. The pAg was decreased to 7.75 during a 2 minute addition of 2.5M silver nitrate solution at 25 ml/minute. The pAg was maintained at 7.75 during addition of 2.5M $AgNO_3$ for 15 minutes at 25 ml/minute to obtain Dispersion A containing silver iodobromide cubes of 3 mol % bulk iodide content and 0.06 μm average grain size.

A dispersion of spectral sensitizing dye in organic medium (Dispersion B) was prepared by mixing 10 g of green sensitizing dye A with 20 g of a 10% solution of Aerosol OT™ (American Cyanamid) in ethyl acetate and 70 g ethyl acetate in a jar. 240 ml of 1.8 mm zirconium oxide beads were added to the jar, which was then placed on a roller mill at 23.77 m per minute for 5 days. 100 g of ethyl acetate were added after milling to discharge the dispersion at approximately 5% dye. 4 g of this dispersion were mixed with 5 g of a 15% solution of Picotoner 1221™ (Hercules) in ethyl acetate to make Dispersion B.

The structure of sensitizing dye A utilized in the preparation of Dispersion B was as follows:

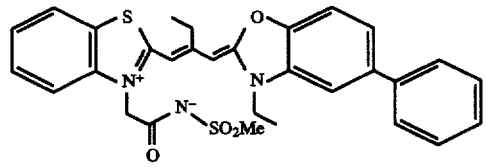

Latent image forming units were prepared by taking 0.5 ml of a 0.035M solution of decyltrimethylammonium bromide (promoter) in water and adding to it 10 g of Dispersion A and 12 g of a 0.5M solution of $NaNO_3$, followed by 9 g of Dispersion B. The resulting mixture was agitated to form a series of aqueous-organic interfaces by shearing using rotor-stator mixer at 13,500 rpm for 2 minutes. It was then stirred, uncovered, for 3 hours to evaporate the ethyl acetate. After the ethyl acetate was removed, the mixture was added to 30 g of a solution containing 6% gelatin and 0.6% Alkanol XC™ (DuPont). The completed procedure resulted in gelatin dispersed 3–4 μm latent image forming units comprising multiple solid sensitizing dye crystals substantially surrounded or encapsulated by silver halide (Dispersion C). A cross-section of the gelatin dispersed latent image forming units is shown by transmission electron microscopy in FIG. 1. The silver halide grains of Dispersion A are indicated by the small black dots on the surface of the spectral sensitizing dye dispersion (B).

Photographic activity of the above-described latent image forming units were evaluated as follows: Dispersion C was coated in a layer containing 0.32 $g/m^2$ of silver and 1.6 $g/m^2$ of gelatin. This was overcoated with a layer containing 0.32 $g/m^2$ of a cyan dye forming coupler and 3.2 $g/m^2$ gelatin. The entire coating was hardened with bis(vinylsulfonylmethyl)ether at 1.75% of the total gelatin level to obtain a photographic element in accordance with the present invention. A comparative photographic element was constructed by conventionally dying Dispersion A with 50 mmol/mol of spectral sensitizing dye A and coating this dispersion in the same manner as for Dispersion C.

Figure 2:
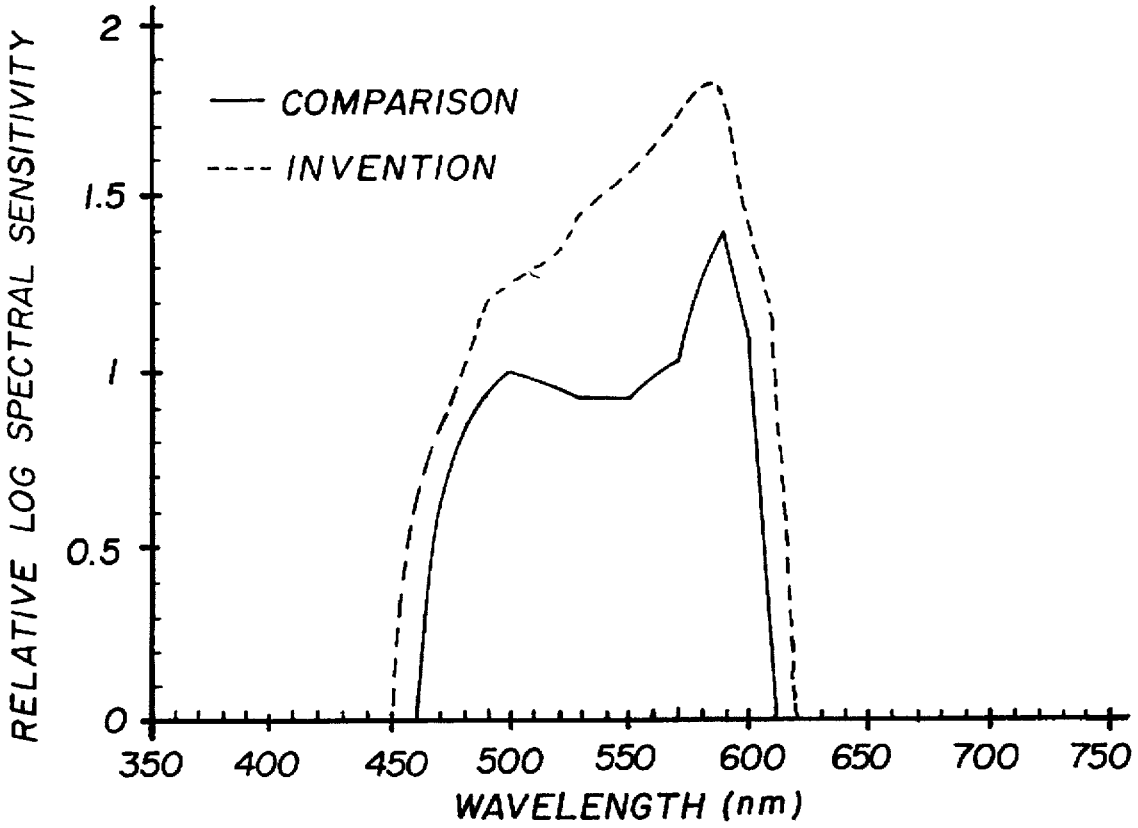
FIG. 2 represents a plot of relative log spectral sensitivity versus wavelength for a photographic element containing the latent image forming units formed in Example 1. Also shown as a comparative example is a plot for a conventionally dyed element.

The coatings were exposed on a spectral sensitometer with a superimposed step tablet and developed for 3 minutes 15 seconds in the conventional C41™ (Eastman Kodak Company) color process to yield a cyan image. A Density versus log Exposure curve was determined for each element at each 10 nm interval between 380 and 700 nm. The speed at a density of 0.15 above $D_{min}$ was read from each D log E curve, adjusted for the incident energy distribution in the spectral range, and plotted against the wavelength to obtain the relative log spectral sensitivity curve shown in FIG. 2. FIG. 2 demonstrates that the photographic elements of the present invention which incorporate latent image forming units as prepared above exhibit enhanced sensitivity as compared to conventionally dyed elements, especially in the region of 530 to 580 nm.

Example 2

The photographic advantages of incorporating multiple types of spectral sensitizing dyes in the latent image forming units was explored in this example.

A Dispersion D was prepared by mixing 5 g of red sensitizing dye B with 20 g of a 10% solution of Aerosol OT™ (American Cyanamid) in ethyl acetate and 35 g of ethyl acetate in a jar. 120 ml of 1.8 mm zirconium oxide beads were added to the jar, which was then placed on a roller mill at 21.34 m per minute for 10 days. 35 g of ethyl acetate were added after milling to discharge the dispersion at approximately 6% dye. 1.15 g of Dispersion B as prepared in Example 1 was mixed with 1.15 g of this dispersion D and 6.7 g of a 15% solution of Picotoner 1221™ (Hercules) in ethyl acetate to make Dispersion D.

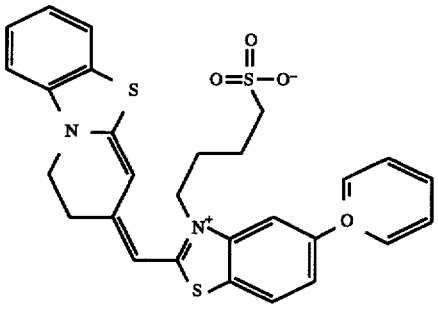

To 30 g of Dispersion A, 1.5 g of a 1% solution of decyltrimethylammonium bromide followed by Dispersion D was added. The resulting composite dispersion was agitated by shearing using rotor-stator mixer at 13,500 rpm for 2 minutes. It was then stirred, uncovered, for 3 hours to evaporate the ethyl acetate. After the ethyl acetate was removed, the mixture was added to 30 g of a solution containing 6% gelatin and 0.6% Alkanol XC™ (DuPont). The completed procedure resulted in gelatin dispersed 3–4 μm latent image forming units comprising multiple types of solid sensitizing dye crystals substantially surrounded or encapsulated by silver halide (Dispersion E).

Photographic activity of the above-described latent image forming units were evaluated as follows: Dispersion E was coated in a layer containing 0.32 g/m$^2$ of silver and 1.6 g/m$^2$ of gelatin. This was overcoated with a layer containing 3.2 g/m$^2$ of gelatin. The entire coating was hardened with bis(vinylsulfonyl-methyl)ether at 1.75% of the total gelatin level to obtain a photographic element in accordance with the present invention.

The element was exposed on a spectral sensitometer with a superimposed step tablet and processed in a conventional black and white developer. The element exhibited a discernible density across a broad spectrum. Specifically, it showed measurable density in the wavelength range of 500 to 680nm.

The invention has been described in detail with particular reference to preferred embodiments thereof, but it will be understood that variations and modifications can be effected within the spirit and scope of the invention.

What is claimed is:

1. A photographic element comprising a silver halide emulsion having incorporated therein a latent image forming unit, said unit being comprised of an agglomeration of silver halide in conductive contact with a light absorbing center, wherein the center is comprised of:

(i) an amorphous or liquid crystalline spectral sensitizing dye; or (ii) a plurality of spectral sensitizing dye crystals; and wherein the light absorbing center further comprises a binder, surfactant or stabilizer.

2. A photographic element according to claim 1 wherein the silver halide substantially encapsulates the light absorbing center.

3. A photographic element according to claim 2 wherein the latent image forming unit has an equivalent circular diameter of from about 0.1 to about 10 μm.

4. A photographic element according to claim 3 wherein the spectral sensitizing dye is selected from the group consisting of methine, cyanine and merocyanine dyes.

5. A photographic element according to claim 1 wherein the latent image forming unit contains an amount of spectral sensitizing dye from about 0.5 to about 5000 millimoles per mole of silver.

6. A photographic element according to claim 5 wherein the latent image forming unit contains an amount of spectral sensitizing dye from greater than 1 to about 1000 millimoles per mole of silver.

7. A photographic element according to claim 6 wherein the latent image forming unit contains an amount of spectral sensitizing dye from about 2 to about 500 millimoles per mole of silver.

8. A photographic element according to claim 1 wherein the light absorbing center is comprised of a plurality of spectral sensitizing dye crystals substantially encapsulated by an agglomeration of silver halide wherein the dye is in an amount from greater than 1 to about 1000 millimoles per mole of silver.

9. A photographic element according to claim 8 wherein the latent image forming unit has an equivalent circular diameter of from about 0.1 to about 10 μm.

10. A process of preparing a photographic emulsion having incorporated therein a plurality of latent image forming units, each of said units being comprised of an agglomeration of silver halide in conductive contact with a spectral sensitizing dye, the process comprising:

dispersing a spectral sensitizing dye in an organic medium to form an organic dispersion;

contacting the organic dispersion with an aqueous colloidal dispersion of silver halide grains and providing sufficient agitation to the dispersions to form a series of interfaces between the organic and aqueous phases; and providing to the dispersions a promoter which facilitates the adsorption of the silver halide grains to the interfaces between the organic and aqueous phases to form the latent image forming units.

11. A process of preparing a photographic emulsion according to claim 10 wherein the silver halide is adsorbed to the interfaces of the organic and aqueous phases in an amount sufficient to substantially encapsulate the spectral sensitizing dye.

12. A process of preparing a photographic emulsion according to claim 11 wherein the spectral sensitizing dye is an amorphous or liquid crystalline spectral sensitizing dye, or is in the form of a plurality of spectral sensitizing dye crystals.

13. A process of preparing a photographic emulsion according to claim 12 wherein the spectral sensitizing dye is in the form of a plurality of spectral sensitizing dye crystals.

14. A process of preparing a photographic emulsion according to claim 13 wherein the organic medium is ethyl acetate.

15. A process of preparing a photographic emulsion according to claim 14 wherein the promoter is an anionic or cationic salt containing from 1 to 20 carbon atoms.

16. A process of preparing a photographic emulsion according to 15 wherein at least 50 percent of the latent image forming units have an equivalent circular diameter of from about 0.1 to about 10 μm.

17. A process of preparing a photographic emulsion according to claim 16 wherein the spectral sensitizing dye is selected from the group consisting of methine, cyanine or merocyanine dyes.

18. A process of preparing a photographic emulsion according to claim 17 wherein the latent image forming units contain an amount of spectral sensitizing dye from about 0.5 to about 5000 millimoles per mole of silver.

19. A process of preparing a photographic emulsion according to claim 10 further comprising removing the organic medium from the latent image forming units by evaporation, dialysis or washing.

20. A process of preparing a photographic emulsion according to claim 19 further comprising adding to the organic dispersion a hydrophobic stabilizer and hydrophobic binder.

21. A process of preparing a photographic emulsion according to claim 20 further comprising adding to the emulsion a hydrophilic colloid after contacting the organic dispersion with the aqueous colloidal dispersion of silver halide grains.

22. A process of preparing a photographic emulsion according to claim 10 further comprising ripening additional silver halide onto the surfaces of the latent image forming units.

* * * * *